United States Patent [19]

Shapland

[11] 4,269,134

[45] May 26, 1981

[54] SAILBOAT WITH UNIVERSAL ROLL FURLING SAIL HOUSING

[76] Inventor: Earl P. Shapland, 2024 Whitfield Park Dr., Sarasota, Fla. 33580

[21] Appl. No.: 938,693

[22] Filed: Aug. 31, 1978

[51] Int. Cl.[3] ..... B63H 9/10

[52] U.S. Cl. ..... 114/107

[58] Field of Search ..... 114/39, 90, 91, 95, 114/97, 98, 102–112, 204, 219

[56] References Cited

U.S. PATENT DOCUMENTS

| | | | |
|---|---|---|---|
| 3,835,804 | 9/1974 | Jackson | 114/107 |
| 4,057,023 | 11/1977 | Hood et al. | 114/107 |
| 4,059,063 | 11/1977 | Hood et al. | 114/106 |
| 4,149,482 | 4/1979 | Hoyt | 114/106 |

FOREIGN PATENT DOCUMENTS

| | | | |
|---|---|---|---|
| 1340777 | 12/1973 | United Kingdom | 114/107 |

*Primary Examiner*—Trygve M. Blix
*Assistant Examiner*—Jesus D. Sotelo
*Attorney, Agent, or Firm*—LeBlanc, Nolan, Shur & Nies

[57] ABSTRACT

A sailboat roll furling system in which sails can be roll-furled inside of an extruded housing which is pivotally mounted on existing masts, headstays or under yard-arms of square rigged vessels. The housing encloses a luff wire mounted for rotation within the housing by a pulley system. An arrangement including a boom car with line and pulley system is used to control the shape of the leech of the mainsail.

37 Claims, 9 Drawing Figures

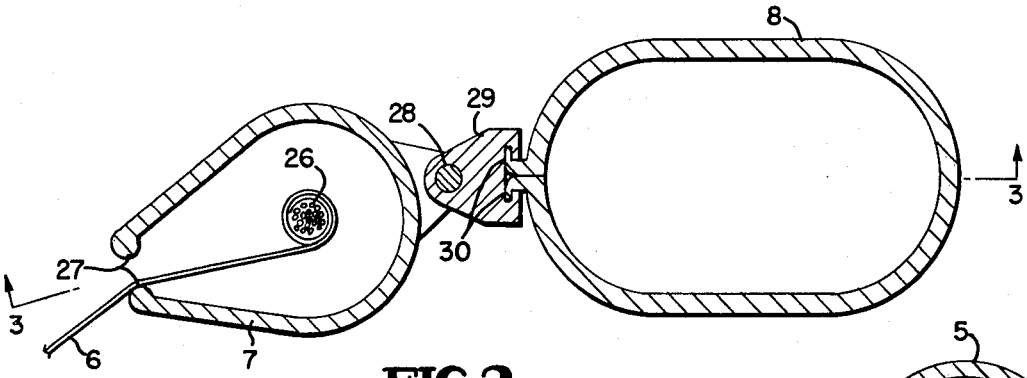
FIG. 2
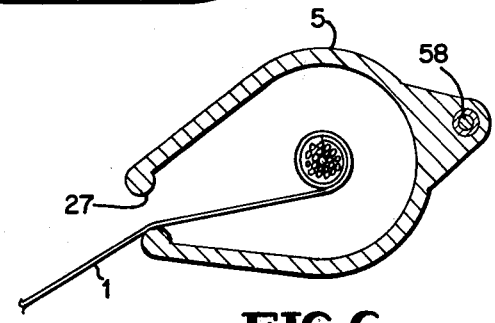
FIG. 6
FIG. 5
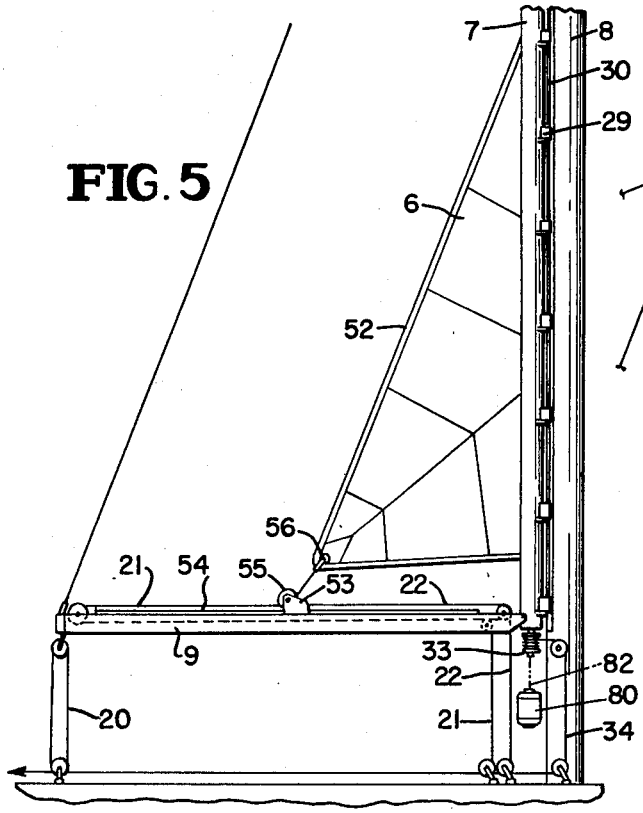
FIG. 7
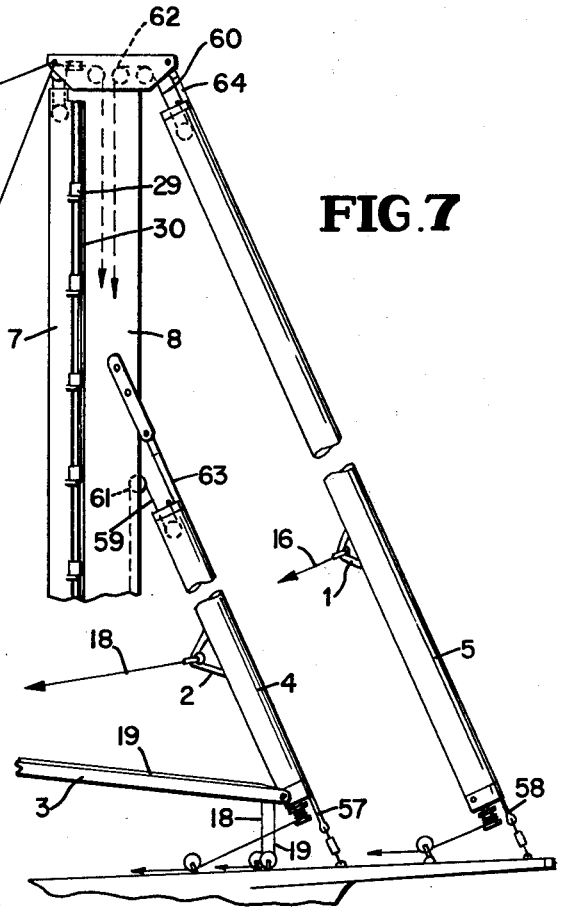

SAILBOAT WITH UNIVERSAL ROLL FURLING SAIL HOUSING

BACKGROUND OF THE INVENTION

This invention relates to sailboats and more specifically to those utilizing roller furling equipment to furl or roller reef any or all of the head, stay and main sails.

Roller furling and roller reefing allow setting and reefing of the sails from the cockpit and thus make practical single-handed and foul-weather sailing; however certain drawbacks have occured with previous equipment. Roller reefing (boom rolling) teachings are found in U.S. Pat. Nos. 2,561,253 to Wells-Coates; and 3,285,215 to Potter. Most arrangements for roller furling utilize a steel cable sewn into the luff or leading edge of the sail. Such teachings can be found in the following U.S. Pat. Nos. 3,602,180 to Holmes; 3,749,042 and 3,749,043, both to Jackson; and 4,034,694 to Dismukes. Using that technique the luff wire is stretched behind the headstay in the case of a headsail or behind the mast in the case of a main or mizzen sail. When the luff wire is rotated by any one of several means, the sail is wound around the luff wire. The primary disadvantage of this lies in the fact that the luff wire will sag even when tensioned highly and when it sags to leeward changes the shape and position of the sail, causing it to be less efficient. In addition, in the case of a headsail the balance of tension between the headstay and headsail luff wire is critical to prevent them from winding together. Various attempts have been made to correct this winding tendency. The first was to utilize the luff wire as the headstay but this prevented taking down the sail in an emergency and later, more successful, efforts utilize special shapes, either replacing the headstay or surrounding it, that have grooves to accept the luff of the sail. A U.S. Pat. No. 3,802,373 to Lagerquist shows an encapsulating sleeve for the head stay of a sailboat and the sleeve provides a track for the luff cable of aforesaid however, the sail is not a roller furled sail. Some disclosures of roll furling around a mast can be seen in British Pat. No. 601,605 and French Pat. No. 787,237.

Recently, a method of furling the main sail inside the mast so that the luff cannot sag to leeward has been patented. See U.S. Pat. Nos. 3,835,804 to Jackson; 4,030,439 to Hood; 4,090,461 to Rusich; and 4,057,023 to Hood et al. This method requires an expensive replacement or modification of the mast and boom when applied to existing boats and requires special heavy mast sections when installed on new boats.

A special boom arrangement for use with roll furled sails is disclosed in Hood et al U.S. Pat. No. 4,059,063.

SUMMARY OF THE INVENTION

The primary object of this invention is to provide a means of overcoming the above described shortcomings while at the same time providing an economical conversion for new or existing sailboats. A further object, is to provide a cover or housing for the roller furled sail to protect it from sun and weather damage when furled. A further object is to provide a means to control the leech of a partially furled sail as a partially furled sail cannot be adequately controlled by means of a boom sheet.

In order to accomplish these objectives, this invention provides a rigid housing surrounding the luff wire and sail when furled that may be hingedly attached to the mast or yard at multiple points or hingedly attached to the head stay over its entire length. This housing utilizes a slot in its trailing edge to allow the sail to be furled and unfurled.

It is furthermore an object of this invention to enable the combination of a sailboat using one or more universal metal sail housings, pivotally mounted on existing masts, stays or yardarms with the housing enclosing a sail luff wire mounted for rotation within the housing and means to rotate the luff wire so the sail may be furled within and unfurled from the housing. In connection with this object a further object resides in providing an improved boom structure with a boom car and sheave arrangement to enable proper disposition of the leech of a mainsail wherever the sail is partially or even wholly furled.

Further novel features and other objects of this invention will become apparent from the following detailed description, discussion and the appended claims taken in conjunction with the accompanying drawings.

BRIEF DESCRIPTION OF DRAWINGS

A preferred structural embodiment of this invention is disclosed in the accompanying drawings, in which:

FIG. 2 is an enlarged section view taken on line 2—2 of FIG. 3 showing the attachment of the universal roll-furling housing to the main mast;

FIG. 5 (on the sheet with FIG. 2) is an enlarged elevation of the lower portion of the main mast and boom showing the attachment to the mast and a special arrangement of the outhaul and down haul lines on the boom.

FIG. 6 is a cross-section of the universal housing and the headstay showing the use of the housing with a headsail;

FIG. 7 is an enlarged detail elevation of the headsail installations of the boat in FIG. 1;

Figure 1:
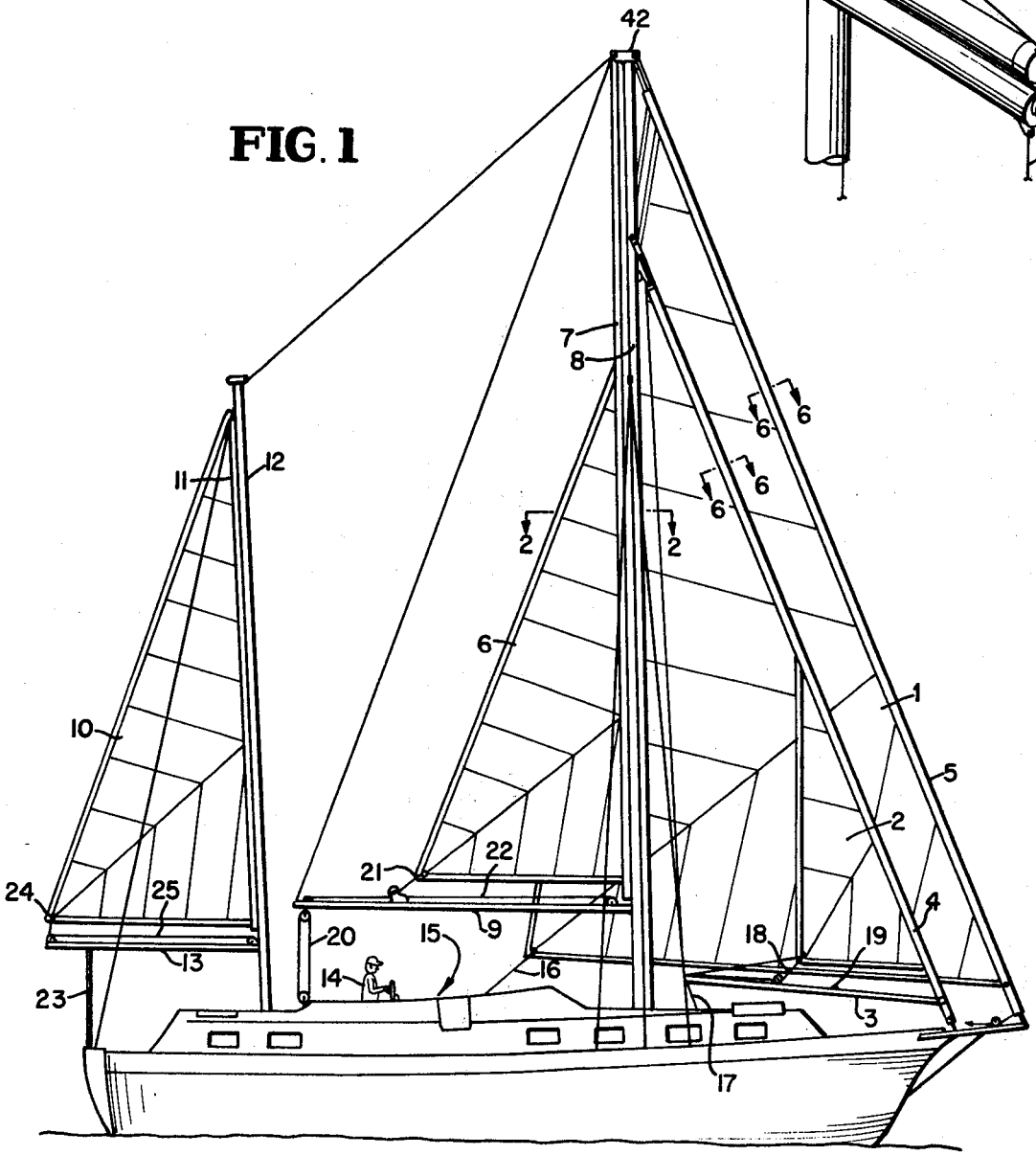
FIG. 1 is a side elevation of a jib headed ketch showing the application of the roll-furling housing of the present invention to all sails.

The sailboat shown in FIG. 1 has two headsails, a loose-footed genoa 1, and a club footed jib 2. The club footed jib 2, carries a club 3 and is shown partially furled into a sail housing 4. The genoa 1 is unfurled completely from its sail housing 5. The mainsail 6 is shown partially furled or reefed into its sail housing 7 which is attached to the aft edge of the main mast 8 and footed to the main boom 9. The mizzen sail 10 is shown fully unfurled from its sail housing 11 which is attached to the aft edge of the mizzen mast 12 and is shown footed to the mizzen boom 13. The helmsman 14 is shown in the cockpit 15. All sail control lines, genoa sheet 16, club jib sheet 17, club jib outhaul 18, club jib down haul 19, main sheet 20, main outhaul 21, main down haul 22, mizzen sheet 23, mizzen outhaul 24, mizzen down haul 25, and the four furling lines from the four sail housings lead to the cockpit 15 so that the sails may be unfurled, trimmed and furled without leaving the cockpit.

FIGS. 2 shows a cross-section through the main mast 8, main sail 6, and main sail housing 7. The main sail 6 is shown partially furled about its luff wire 26. The luff wire is larger in diameter than the furling slot 27 in the aft edge of the sail housing 7. This is to prevent the sail under load from pulling the luff wire 26 out of the sail housing 7. This sail housing 7 is carried on a long rod or hinge pin 28 which is attached to the main mast 8 by means of hinge halves 29. The hinge halves 29 in this illustration are slid onto the existing main mast sail track 30 which is riveted to the main mast 8 but the hinge halves 29 could be attached directly to the main mast 8 by riveting, screwing or welding or could even be formed as an integral part of the mast.

Figure 3:
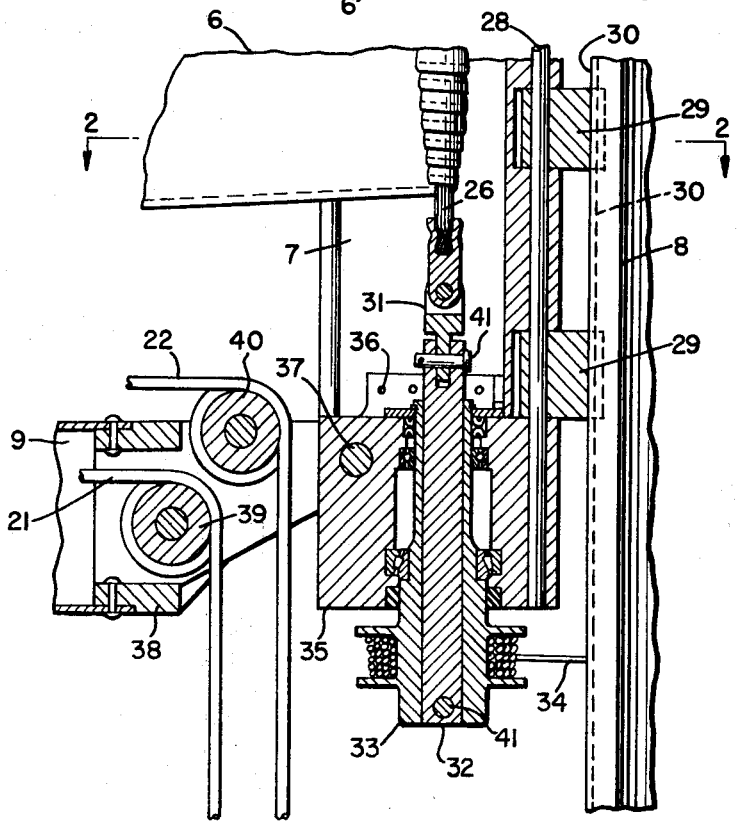
FIG. 3 is an enlarged detail section of the housing and mast combination taken on line 3—3 of FIG. 2 showing the lower portion of the combined structure.

FIG. 3 shows a cross section at the lower end of the main mast 8, sail housing 7, and the gooseneck of main boom 9. The main sail 6 is shown partially furled on the main sail luff wire 26 which is attached through a universal joint 31 to the furling drum shaft 32 and to furling drum 33 by means of pin 41. The furling line 34 is wrapped around the furling drum 33 in such a manner that when the furling line 34 is pulled it causes the sail to wrap around the luff wire 26. Furling could be accomplished by other means such as reversible electric or hydraulic motor drive or crank operators. (See schematic motor 80 and its connection 82 to the pulley shaft as depicted in FIG. 5). In this embodiment, the furling drum 33 and shaft 32 are carried in bearings mounted in the sail housing lower casting 35 which is attached rigidly to the lower end of the sail housing 7 by rivets 36. The sail housing lower casting 35 constitutes a lower end cover, also carries the boom pivot pin 37 and the boom 9 is connected to this boom pivot pin 37 by the boom gooseneck 38 which also carries the outhaul turning sheave 39 and down haul turning sheave 40. It should be noted here that as the boom swings to leeward under sail, the sail housing lower casting 35 and sail housing 7 swing with it as the whole assembly pivots on hinge pin 28.

Figure 9:
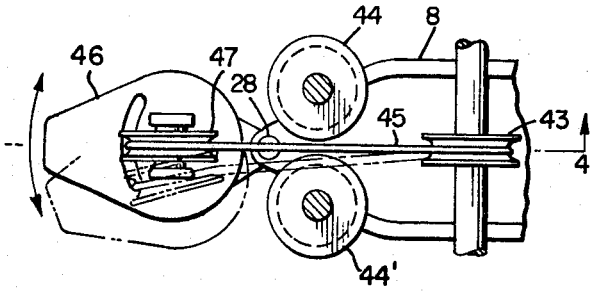
FIG. 9 (on the sheet with FIG. 4) is a cross-section taken on line 9—9 of FIG. 4 showing the pulley or sheave arrangement at the mast head.
Figure 4:
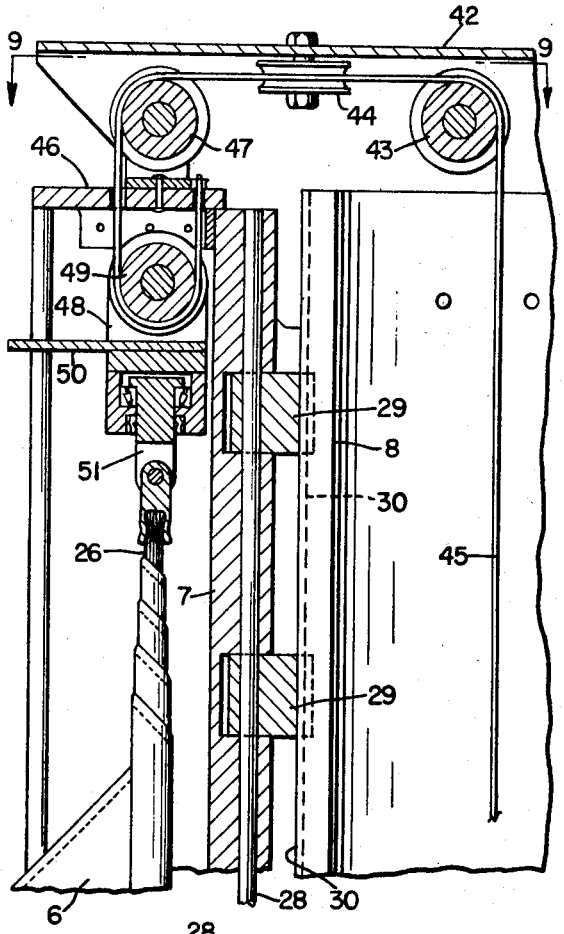
FIG. 4 is an enlarged detail section of the housing and mast combination taken on line 4—4 of FIG. 9 showing the upper portion of the combined structure.

FIG. 4 (on the same sheet and aligned with FIG. 3) shows the upper end of the main mast and mainsail housing assembly. Again, the sail housing 7 is shown attached to the mast 8 by means of hinge pin 28 and hinge halves 29. The mast has a mast head assembly 42 (see also FIGS. 7 and 9), carries a mast head turning sheave 43 and a pair of guide sheaves 44 and 44'. These guide sheaves 44 guide the main halyard 45 as the upper turning sheave 47 swings about hinge pin 28. The main sail housing 7 has attached to its upper end, the sail housing upper casting 46 constitutes an upper end cover which carries the sail housing upper turning sheave 47 and the fixed end of the main halyard 45. The upper end of the main sail luff wire 26 is attached to the swivel assembly 48 which carries the swivel sheave 49 and a guide lug 50 which extends through the slot 27 in the aft edge of the sail housing and prevents the upper portion of the swivel assembly 48 from rotating when the sail is furled and unfurled. The swivel shaft 51, to which the upper end of the main sail luff wire 26 is connected, is mounted in a bearing in the swivel block assembly 48.

In an emergency, the sail may be lowered when furled or when unfurled. While the luff wire 26 is larger than the furling slot 27 to prevent it from pulling out through the slot, the slot is widened by cutting away or deforming in the lower few feet of the slot to allow the luff wire to come out at that point. In order to lower the sail, tension is relaxed on the main halyard 45 and, at the lower end of the sail housing, pin 41 in the furling drum shaft 32 (FIG. 3) is removed. The furling drum shaft is lifted out of the furling drum 33 and guided out through the widened portion of the furling slot 27. As the halyard 45 is further relaxed, the sail 6 and luff wire 26 are passed out through the widened portion of the furling slot.

FIG. 5 illustrates a unique arrangement to allow control of the leech 52 or trailing edge of the sail. The leech of a conventional sail uses battens and tension on the sheet 20 to control the shape of the leech 52. A roller furled sail cannot utilize battens as they are too rigid and while tension on the sheet will pull down the leech when the sail is fully unfurled, sheet tension is ineffective in pulling down the leech if the sail is partially furled. Shown in FIG. 5 is a boom car 53 riding on boom track 54 and carrying car sheave 55. The boom car 53 may be pulled toward the mast by pulling on down haul line 22. The outhaul 21 is attached to the clew of the sail at cringle 56 then passes through the boom car sheave 55 and through various turning sheaves to the cockpit 15 (FIG. 1). When the sail is unfurled, the downhaul line 22 is released allowing the boom car to go to the outer end of the boom. The sail is then unfurled by pulling on the out haul until it is in the desired position. The furling line 34 is then tied off to prevent further unfurling and the boom car 53 is pulled in by pulling on the down haul 22 to position the boom car sheave 55 below the position of the leech 52 and cringle 56. Tension on the sheet 20 will then pull down the leech 52 to the desired shape.

FIG. 6 shows a section through the sail housing of one of the head sails. Like the main sail, the head sail 1 or 2, extends through the furling slot 27 and is wound around its luff wire inside the said housing 4 or 5. The sail housing 4 or 5 has a head stay 57 or 58, passed through a hole extending lengthwise at its leading edge and is supported by the head stay 57 or 58. When the universal housing is used on a head stay, the leading edge need not be cut away to provide hinging sections, although if desired the same hinged configuration used on masts can be used on stays.

FIG. 7 shows an elevation of the headsails and main mast head. The sail housings 4 and 5, use the same lower furling assembly as shown on the main sail housing in FIG. 3 and the same upper housing casting and swivel assembly as the main sail housing shown in FIG. 4. The halyards 59 and 60 are passed over turning sheaves 61 and 62 mounted in or on the main mast and mast head assembly. The sail housings 4 and 5 are held in their proper positions against halyard tension by means of tubular spacers 63 and 64 placed around the head stays 57 and 58.

Figure 8:
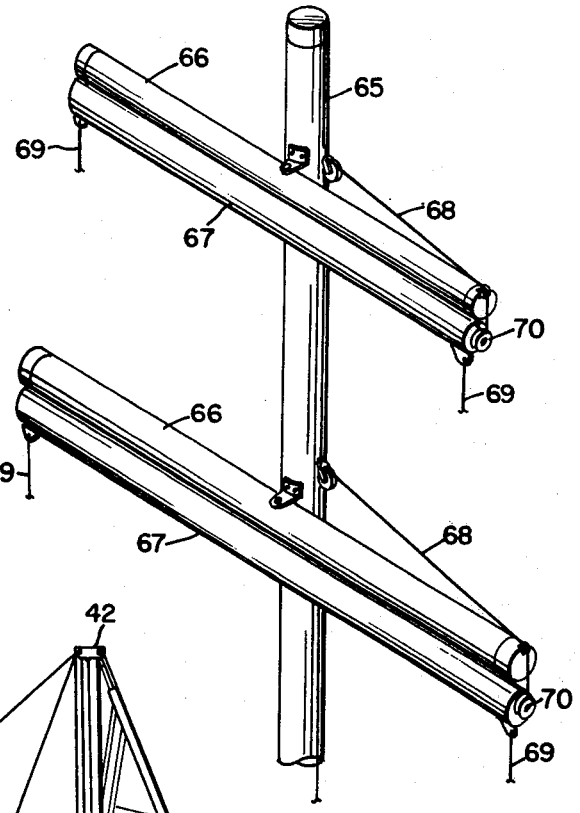
FIG. 8 (on the sheet with FIG. 1) is an isometric view of the mast and yards of a square rigged sailing vessel showing the application of the universal housing to square rigged sails.

FIG. 8 illustrates how the sail housing may be applied to a square rigged vessel. Shown in a square rigged mast 65 and two yards 66. Sail housing 67 are suspended below the yard in the same manner that the main sail housing is attached to the main mast in FIGS. 3 and 4. The sails are furled by pulling on furling lines 68 and unfurled by pulling on sheets 69. The housings are extrusions essentially identical to the previously described housing with a swivel attachment at one end and a pulley 70 at the outer end of the luff wire.

The invention may be embodied in other specific forms without departing from the scope, spirit or essential characteristics thereof. The present embodiments are, therefore, to be considered in all respects as illustrative and not restrictive, the scope and spirit of the invention being indicated by the appended claims rather than by the foregoing description, and all changes which come within the meaning and range of equivalency of the claims are, therefore, intended to be embraced therein.

What is claimed and desired to be secured by Letters Patent is:

1. A sail furling apparatus comprising: an elongate hollow sail housing having a leading edge with hinge means disposed on the leading edge providing a housing pivot axis substantially paralleling said leading edge and a slot opening along the housing trailing edge providing entrance means for a sail to be furled within and unfurled from the housing; and means mounted in the housing for rotatably securing a sail luff wire between the ends of the housing including means at one end of said housing for rotating said luff wire to furl a sail around said luff wire and within said housing.

2. A sail furling apparatus as defined in claim 1, wherein said hinge means comprises a plurality of spaced-apart hinge half sections on the leading edge of said housing, said sections having aligned bores in the sections so that the hinge half sections can be interfitted and hingedly interlocked with a plurality of other hinge half units.

3. A sail furling apparatus as defined in claim 1, wherein said hinge means comprises means on the forward edge of said housing providing a through bore extending from adjacent the top to adjacent the bottom of said housing, the bore providing the means whereby the housing can be mounted on an elongate member for swinging about the axis of said through bore.

4. A sail furling apparatus as defined in claim 1, 2 or 3 wherein the cross-section of said housing provides an enlarged cavity with a closed front end and having two side walls terminating in closely adjacent but spaced-apart free edges to provide a slotted aperture at the trailing edge of the housing wide enough to enable a sail to pass freely therethrough and close enough to prevent a sail luff wire to pass therethrough; the front end wall of the housing having integral forward projection means which includes said hinge means.

5. A sail furling apparatus as defined in claim 4, wherein structure secured at one end of said housing includes luff wire journal means and said luff wire rotating means is journalled in said journal means.

6. A sail furling apparatus as defined in claim 5, wherein said luff wire rotating means includes a line drum and drum drive shaft, said shaft being rotatably journalled in said journal means and including means adapted to be releasably secured to one end of a luff wire.

7. A sail furling apparatus as defined in claim 5, wherein said luff wire rotating means includes a motor and a rotatable shaft connected to and rotatable by said motor.

8. A sail furling apparatus as defined in claim 5, wherein said structure at one end of said housing includes means adapted to mount the gooseneck means of a boom.

9. A sail furling apparatus as defined in claim 8 wherein structure secured at the other end of said housing provides luff wire journalling means adjacent that other end of said housing.

10. A sail furling apparatus as defined in claim 9, wherein said structure at said other end of the housing journals an upper turning sheave located exterior of said housing, a swivel assembly with a journalled swivel sheave and a main halyard anchor means, said journalled swivel sheave having means adapted to be releasably connected to the other end of said luff wire.

11. A sail furling apparatus as defined in claim 1, 2 or 3 wherein said housing comprises an extruded metal structure and means are secured to each end of the extruded structure, providing end covers and means for rotatably securing a luff wire within said housing.

12. A sail furling apparatus as defined in claim 11, wherein said housing has a cross-section of substantially tear-drop shape.

13. A sail furling apparatus as defined in claim 1, wherein said hinge means comprises a plurality of spaced-apart hinge half sections on the leading edge of said housing from adjacent the top to adjacent the bottom of said housing, said sections having aligned bores in the sections providing the means whereby the housing can be mounted on an elongate member for swinging about the axis of said aligned bores.

14. A sailboat comprising: at least one mast and at least one roll furling sail including a luff wire on said sail; a sail furling apparatus comprising: an elongate hollow sail housing having a first edge, hinge means disposed along said first edge providing a housing pivot axis substantially paralleling said first edge and a slot opening along a second housing edge opposite said first edge providing entrance means for a sail to be furled within and unfurled from the housing; means mounted in the housing for rotatably securing said sail luff wire between the ends of the housing including means at one end of said housing for rotating said luff wire to furl the sail around said luff wire and within said housing; said sail housing hinge means providing at least part of a hinging arrangement; means connected to said mast providing the remainder of the hinging arrangement so that said furling apparatus can be pivotally secured to said sailboat to provide pivoting of said housing to permit the housing to follow the movement of the sail so the luff portion of the sail always passes substantially straight through the slotted edge of the housing to the luff wire.

15. A sailboat as defined in claim 14, wherein said means connected to said mast to provide said remainder of the hinging arrangement are hinging lugs and a pivot pin and the sail is a mainsail.

16. A sailboat as defined in claim 15, further including a mizzen mast, a furling mizzensail and a second of said furling apparatus carried on said mizzen mast.

17. A sailboat as defined in claim 15 or 16, wherein a mainsail boom is provided and comprises: an elongate member with fore and aft ends and a track provided along its upper surface between the two ends; said front end comprising a boom attachment goose neck with a forward pivot fitting connected to the lower end of said sail housing; outhaul and downhaul sheaves rotatably mounted in said goose neck; a turning sheave mounted on the boom at the aft end of the track; a sheet sheave mounted on the boom under its aft end; a boom car retained in said track to ride fore and aft along said boom and including a single boom car sheave rotatable on a lateral axis transverse to the path of travel of said car; and means on the front end of said boom car to secure the end of the downhaul; and an outhaul line passing over the outhaul sheave thence to the turning sheave and under the boom car sheave thence to a terminal connection on the corner of the mainsail.

18. A sailboat as defined in claim 14, wherein said means connected to said mast to provide the remainder of the hinging arrangement is a stay connected between said mast and said sailboat and said sail is a staysail.

19. A sailboat as defined in claim 14, wherein said sailboat has plural masts and plural stays and at least one of said masts and at least one of said stays pivotally carries a said furling apparatus.

20. A sailboat as defined in claim 14, wherein said sailboat is square rigged and said remainder of the hinging arrangement is secured to the lower part of a yardarm; and the means to furl the sail includes a furling line at one end of the housing reaved over a sheave on the adjacent end of the associated yardarm and through a block secured to the mast, thence down to the body of the sailboat.

21. A sailboat as defined in claim 14, wherein said mast is a stayed mast.

22. A sailboat comprising: at least one mast and at least one furling sail including a luff wire thereon; a sail furling apparatus comprising: an elongate hollow sail housing having a leading edge with a first portion of hinge means disposed along the leading edge providing a housing pivot axis substantially paralleling said leading edge and a slot opening along the housing trailing edge providing entrance means for a sail to be furled within and unfurled from the housing; and means mounted in the housing for rotatably securing a sail luff wire between the ends of the housing including means at one end of said housing for rotating said luff wire to furl a sail around said luff wire and within said housing; and means connected to said mast providing the remainder of the hinge means so that said furling apparatus can be pivotally secured to said sail boat and provide pivoting of said housing to permit the housing to follow the movement of the sail so the luff portion of the sail always passes substantially straight through the slotted edge of the housing to the luff wire.

23. A sailboat as defined in claim 22, wherein said first portion of said hinge means comprises a plurality of spaced-apart hinge half sections on the leading edge of said housing, said sections having aligned bores in the sections so that the hinge half sections can be interfitted and hingedly interlocked with said remaining portion of said hinge means which comprises a plurality of other hinge half units secured to sailboat structure.

24. A sailboat with furling apparatus as defined in claim 22, wherein said first portion of said hinge means comprises means on the forward edge of said housing providing a through bore extending from adjacent the top to adjacent the bottom of said housing, the bore providing the means whereby the housing can be mounted on an elongate member for swinging about the axis of said through bore.

25. A sailboat with furling apparatus as defined in claim 22, 23 or 24, wherein the cross-section of said housing provides an enlarged cavity with a closed front end and having two side walls terminating in closely adjacent but spaced-apart free edges to provide a slotted aperture at the trailing edge of the housing wide enough to enable a sail to pass freely therethrough and close enough to prevent a sail luff wire to pass therethrough; the front end wall of the housing having integral forward projection means which includes said first portion of said hinge means.

26. A sailboat with furling apparatus as defined in claim 25, wherein structure secured at one end of said housing includes luff wire journal means and said luff wire rotating means is journalled in said journal means.

27. A sailboat with furling apparatus as defined in claim 26, wherein said luff wire rotating means includes a line drum and drum drive shaft, said shaft being rotatably journalled in said journal means and including means adapted to be releasably secured to one end of a luff wire.

28. A sailboat with furling apparatus as defined in claim 26, wherein said luff wire rotating means includes a motor and a rotatable shaft connected to and rotatable by said motor.

29. A sailboat with furling apparatus as defined in claim 26, wherein said structure at one end of said housing includes means adapted to mount a gooseneck means at the end of a boom.

30. A sailboat as defined in claim 29, wherein said sail is a mainsail and said housing is pivotally secured to a main mast and a mainsail boom is provided and comprises: an elongate member with fore and aft ends and a track provided along its upper surface between the two ends; said front end comprising a boom attachment goose neck means with a forward pivot fitting connected to the means at one end of said sail housing; outhaul and downhaul sheaves rotatably mounted in said goose neck means; a turning sheave mounted on the boom at the aft end of the track; a sheet sheave mounted on the boom under its aft end; a boom car retained in said track to ride fore and aft along said boom and including a single boom car sheave rotatable on a lateral axis transverse to the path of travel of said car; and means on the front end of said boom car to secure the end of the downhaul; and an outhaul line passing over the outhaul sheave thence to the turning sheave and under the boom car sheave thence to a terminal connection on the corner of the mainsail.

31. A sailboat with furling apparatus as defined in claim 29 wherein structure secured at the other end of said housing provides luff wire journalling means adjacent that other end of said housing.

32. A sailboat with furling apparatus as defined in claim 31, wherein said structure at said other end of the housing journals an upper turning sheave located exterior of said housing, a swivel assembly with a journalled swivel sheave and a main sheet anchor means, said journalled swivel sheave having means adapted to be releasably connected to the other end of said luff wire.

33. A sailboat with furling apparatus as defined in claim 32, wherein said housing is pivotally secured to a mast, a mast head assembly provides a turning sheave, a sail halyard passes up the mast and over the mast head turning sheave, over said upper turning sheave on said sail housing down into said housing and around said journalled swivel sheave and up to an anchor connection at the upper end structure of said housing.

34. A sailboat with furling apparatus as defined in claim 33, wherein a pair of guide sheaves on axes parallel to the mast are mounted in said mast head assembly to guide the halyard as it passes between the mast head and housing upper turning sheaves when the sail housing pivots relative to the mast.

35. A sailboat boom and boom car sub-combination for use in combination with furling sails comprising: an elongate member with fore and aft ends and a track provided along its upper surface between the two ends; said front end comprising a boom attachment goose neck with a forward pivot fitting; outhaul and downhaul sheaves rotatably mounted in said goose neck; a turning sleeve mounted on the boom at the aft end of the track; a sheet sheave mounted on the boom under its aft end; a boom car retained in said track to ride fore and aft along said boom and including a single boom car sheave rotatable on a lateral axis transverse to the path of travel of said car; and means on the front end of said boom car to secure the end of the downhaul.

36. A sail furling apparatus as defined in claim 25, wherein said housing comprises an extruded metal structure, the forward projection means are an integral part of said extruded structure, and means are secured to each end of the extruded structure, providing end covers and means for rotatably securing a luff wire within said housing.

37. A sailboat comprising: at least one mast and at least one roll furling sail with a luff wire about which the sail is roll furled; a boom for use with the roll furling sail comprising: an elongate member with fore and aft ends and a track provided along its upper surface between the two ends; said front end comprising a boom attachment goose neck with a forward pivot fitting attached to said mast; outhaul and downhaul lines; outhaul and downhaul sheaves rotatably mounted in said goose neck; a turning sheave mounted on the boom at the aft end of the track; a sheet sheave mounted on the boom under its aft end; a boom car retained in said track to ride fore and aft along said boom and including a single boom car sheave rotatable on a lateral axis transverse to the path of travel of said car; means on the front end of said boom car to secure the end of the downhaul; said downhaul line passing over said downhaul sheave and secured to the means on the front end of said boom car; and said outhaul line passing over said outhaul sheave to and around said turning sheave back to and under said boom car sheave thence to and secured to a clew on the sail.

* * * * *